US009046290B2

(12) United States Patent
Wyn-Davies et al.

(10) Patent No.: US 9,046,290 B2
(45) Date of Patent: Jun. 2, 2015

(54) ENERGY MANAGEMENT SYSTEM

(75) Inventors: Alan Wyn-Davies, Witney (GB); Simon Hopewell, Witney (GB)

(73) Assignee: DFX Technology Limited, Oxfordshire (GB)

( * ) Notice: Subject to any disclaimer, the term of this patent is extended or adjusted under 35 U.S.C. 154(b) by 382 days.

(21) Appl. No.: 13/201,591

(22) PCT Filed: Feb. 3, 2010

(86) PCT No.: PCT/GB2010/050165

§ 371 (c)(1), (2), (4) Date: Aug. 15, 2011

(87) PCT Pub. No.: WO2010/103299

PCT Pub. Date: Sep. 16, 2010

(65) Prior Publication Data

US 2011/0296852 A1 Dec. 8, 2011

(30) Foreign Application Priority Data

Feb. 16, 2009 (GB) ..... 0902418.3

(51) Int. Cl.
*F25D 3/12* (2006.01)
*F25D 29/00* (2006.01)

(52) U.S. Cl.
CPC ..... *F25D 29/00* (2013.01); *F25D 2700/12* (2013.01)

(58) Field of Classification Search
CPC ..... F25D 29/00; F25D 2700/12; F25D 11/00
USPC ..... 62/56, 157, 440, 419, 340, 89, 208, 62/209, 407, 126; 700/276, 295
See application file for complete search history.

(56) References Cited

U.S. PATENT DOCUMENTS

| | | | | |
|---|---|---|---|---|
| 4,439,998 | A * | 4/1984 | Horvay et al. | 62/199 |
| 4,807,443 | A | 2/1989 | Battson et al. | |
| 5,325,678 | A * | 7/1994 | Borah et al. | 62/126 |
| 5,598,713 | A * | 2/1997 | Bartilucci | 62/78 |
| 5,969,606 | A * | 10/1999 | Reber et al. | 340/540 |
| 6,378,315 | B1 * | 4/2002 | Gelber et al. | 62/80 |
| 6,502,409 | B1 * | 1/2003 | Gatling et al. | 62/80 |
| 6,950,095 | B2 * | 9/2005 | Kim et al. | 345/173 |
| 7,013,661 | B2 * | 3/2006 | Gatling et al. | 62/228.3 |
| 7,193,094 | B2 * | 3/2007 | Chipman et al. | 549/536 |
| 7,302,202 | B2 * | 11/2007 | Tai et al. | 399/92 |
| 7,516,622 | B2 * | 4/2009 | Gauthier et al. | 62/157 |
| 7,602,563 | B2 * | 10/2009 | Bloch et al. | 359/820 |

(Continued)

FOREIGN PATENT DOCUMENTS

| | | |
|---|---|---|
| JP | 2006214644 | 2/1990 |
| JP | 2006214644 | 8/2006 |
| WO | PCT/GB2010/050165 | 4/2010 |

*Primary Examiner* — Mohammad M Ali
(74) *Attorney, Agent, or Firm* — Wells St. John P.S.

(57) ABSTRACT

An energy management system for use with a temperature controlled unit for food or beverages. A sensor is provided that comprises means to measure a temperature in the temperature controlled unit, and means to transmit wirelessly the measured temperature to a controller. The controller comprising a memory for storing data, and a processor arranged to control electric power to the temperature controlled unit on the basis of a combination of the measured temperature and the stored data. The stored data defines at least two time periods in which a first temperature is required in the first time period, and a second, different temperature is required during the second time period.

17 Claims, 6 Drawing Sheets

(56) References Cited

U.S. PATENT DOCUMENTS

| | | | | |
|---|---|---|---|---|
| 7,793,513 | B2 * | 9/2010 | Aldridge et al. | 62/263 |
| 8,051,668 | B2 * | 11/2011 | Singh et al. | 62/181 |
| 2003/0014296 | A1 * | 1/2003 | Meine | 705/9 |
| 2003/0052008 | A1 * | 3/2003 | Liu et al. | 204/459 |
| 2003/0130908 | A1 * | 7/2003 | Hing | 705/26 |
| 2003/0150568 | A1 * | 8/2003 | Hileman, Jr. | 160/351 |
| 2004/0060305 | A1 * | 4/2004 | Singh et al. | 62/126 |
| 2004/0093125 | A1 | 5/2004 | Schanin | |
| 2005/0028539 | A1 * | 2/2005 | Singh et al. | 62/127 |
| 2005/0268693 | A1 * | 12/2005 | Hasselbrink et al. | 73/23.42 |
| 2006/0111815 | A1 | 5/2006 | Schanin et al. | |
| 2007/0028146 | A1 * | 2/2007 | Ruckerbauer | 714/42 |
| 2008/0008225 | A1 * | 1/2008 | Ahmad et al. | 374/109 |
| 2008/0141690 | A1 * | 6/2008 | Behr | 62/186 |

* cited by examiner

ENERGY MANAGEMENT SYSTEM

CROSS REFERENCE TO RELATED APPLICATION

This application is a 35 U.S.C. §371 of and claims priority to PCT International Application Number PCT/GB2010/050165 (Publication No. WO 2010/103299 A2), which was filed 3 Feb. 2010, and was published in English, and this application claims priority to UK Patent Application No. 0902418.3 which was filed 16 Feb. 2009, the teachings of which are incorporated herein by reference.

TECHNICAL FIELD

The invention relates to the field of energy management systems, and in particular to cooler management systems for food or beverage coolers.

BACKGROUND

Food and beverage dispensers and vending machines are used widely to store and dispense food and beverages. Typically, the food or drink product contained within such a machine must be kept below a certain temperature, either to prolong the "life" of the product and to ensure that it remains fresh, or because the consumer expects the product (for example, a drink or an ice cream) to be below a certain temperature.

In this document, such devices are referred to as "coolers". There are several different types of cooler. A beverage dispenser/cooler typically comprises a bath of cooled fluid which houses 'product coils'—a series of pipes through which the beverages or ingredients of beverages pass. Cooled fluid is drawn from the bath into a "python", which includes at least one pipe containing cooled fluid from the bath and at least one pipe through which the beverage is dispensed. The proximity of both the bath to the product coil and the pipe containing cooled fluid to the dispensing pipe cools the beverage in the dispensing pipe. The fluid in the cooled fluid pipe circulates between the pipe and the bath, and so is replenished with cooled fluid from the bath.

A similar type of beverage dispenser is a carbonated cooler. In the cooler described above, chilled fluid is pumped directly from the cooler bath and circulates in the python. In a carbonated cooler, carbonated water is circulated in the python. The carbonated water is produced separately in a carbonator bowl by mixing food grade $CO_2$ under pressure with drinking water. In order to cool this carbonated water down it is then passed through a 'product coil', which is situated within the cooler bath. The carbonated water can be diverted from the python into a mixing head where it is mixed directly with a flavoured syrup to produce a carbonated drink. The flavoured syrup will typically have passed through its own product coil within the cooler bath and through the python to lower its temperature prior to mixing it with the carbonated water in the mixing/dispense head. With every drink that is dispensed, the combined volume of carbonated water in the python and carbonator bowl is reduced. There are additional electronics involved in topping up the supply by measuring the level of carbonated water present in the carbonator bowl. Once it reaches a critical minimum level a carbonation cycle is instigated which re-fills it up to the maximum level again.

Another type of cooler is a "glass door" vending machine. This is a vending machine having a cooled compartment in which chilled products are stored. The compartment is accessible using a glass door. Another type of cooler is an "enclosed" vending machine, in which the cooled compartment containing products is not accessible by a customer. When a customer requires a product from the enclosed vending machine, the product is dispensed through a hatch. A further type of cooler is an "open-reach" cabinet, in which a cabinet containing chilled products is provided. The chilled products are directly accessible by a customer and a curtain of air is maintained across the access to the open reach cabinet in order to provide a degree of insulation from the ambient temperature. A further type of cooler is a "dump bin", which comprises a cooled cabinet having an opening at the top through which a customer can access chilled products. A dump bin is not provided with a door, but may have a curtain of air to assist in maintaining a lower temperature than the ambient temperature.

The types of coolers described in the above paragraphs typically use a vapour compression cycle to maintain a low temperature. A refrigerant enters a compressor as a vapour, and is compressed. The compressed vapour passes through a condenser to cool and condense the vapour into liquid form. The liquid then passes through a restriction which causes it to evaporate and cool down. The evaporation takes place in a series of tubes or coils in an evaporation unit, which are cooled. In a beverage/dispense cooler the evaporation unit is immersed in a fluid bath. In the other types of cooler, a fan blows air over the evaporation unit. The air is cooled and circulated into the cooled cabinet and so reduces the temperature of any product stored in the cabinet.

Another type of cooler is a flat plate cooler in which ice is made and placed on a heat exchanger such as an aluminium plate. The reduced temperature of the heat exchanger is then used to cool a product.

Each of these cooling methods can be thought of as having a primary and a secondary cooling mechanism. In the case of the beverage dispenser/cooler, the primary cooling mechanism is that used to cool the bath of fluid and the secondary cooling mechanism comprises using the cooled fluid to cool a beverage. In the case of the refrigerated cabinets, the primary cooling mechanism is the compressor, condenser and evaporator which are used to cool a refrigerant, and the secondary cooling mechanism is the air which is cooled by the refrigerant and subsequently used to cool products within the cabinet.

Considering the situation where a cooler is used in a commercial environment, for example a bar or a restaurant: This environment may require that the products cooled by the cooler are sufficiently cool during trading hours, but it is not so critical to keep them cool during non-trading hours. In order to improve energy efficiency and save energy costs, it would be desirable to introduce systems that allow the cooler to maintain a required temperature during trading hours and to maintain a second required temperature during non-trading hours. The second required temperature in the case of a cooler may be higher than the required temperature during trading hours, as it is only necessary to keep the product fresh rather than provide the product at a temperature required by a customer. There are many examples of improvements to the efficiency of coolers, such as U.S. Pat. No. 4,417,450. This patent describes an energy management system that controls the cycling of a refrigeration system on the basis of trading hours.

As there are many coolers already in use, it would be desirable to allow such an energy management system to be retrofitted to existing coolers. It is possible to retrofit such systems, although this requires either a skilled engineer to visit the site where a cooler is located, or for the cooler to be sent to a site for a retrofit. This is required because the devices typically need re-wiring to connect temperature sensors to controllers, and is a time consuming and expensive process. It would be desirable for a retrofit energy management system to be fitted in such a way as to minimize the time required to retrofit the system.

SUMMARY

The inventors have realised the problems associated with existing cooler management systems and have devised improvements to make them more efficient, and to reduce the costs associated with retrofitting cooler management systems.

According to a first aspect of the invention, there is provided an energy management system for use with a temperature controlled unit for food or beverages, the cooler management system comprising a sensor comprising means to measure a temperature in the temperature controlled unit, and means to transmit wirelessly the measured temperature to a controller. A controller is also provided that comprises a memory for storing data, and a processor arranged to control electric power to the temperature controlled unit on the basis of a combination of the measured temperature and the stored data. The data defines at least two time periods in which a first temperature is required in the first time period, and a second, different temperature is required during the second time period.

As an option, the sensor comprises means for fitting the sensor such that it measures the temperature in one of a chilled cabinet, a cooler bath, a product line, a python, an ice making machine and a climate controlled environment.

The controller is optionally arranged to cut the electric power to the temperature controlled unit in the event that a measured temperature falls below a first predetermined threshold, and restore electric power to the temperature controlled unit in the event that a measured temperature exceeds a second predetermined threshold. This is applicable to coolers. Alternatively, the controller is arranged to cut the electric power to the temperature controlled unit in the event that a measured temperature rises above a first predetermined threshold, and restore electric power to the temperature controlled unit in the event that a measured temperature falls below a second predetermined threshold. This is applicable to heaters.

The controller of the energy management system optionally comprises means for a user to input data, wherein the input data is stored in the memory.

The memory is optionally configured for storing historical data, and the processor is arranged to control electric power to the temperature controlled unit on the basis of the historical data.

As an option, the controller is arranged to be interposed between the temperature controlled unit and a power supply providing electric power to the temperature controlled unit.

In one embodiment, the first temperature is selected to inhibit degradation of the food or beverage, and the second temperature is selected to maintain the food or beverage at a temperature required for consumption of the food or beverage.

As an option, the time periods comprise any combination of daily, weekly, monthly and yearly time periods.

According to a second aspect of the invention, there is provided a temperature controlled unit for controlling the temperature of food or beverages, the temperature controlled unit comprising the energy management system described in the first aspect of the invention.

The temperature controlled unit is optionally selected from a temperature controlled unit for cooling a food or beverage, and a temperature controlled unit for heating a food or beverage.

According to a third aspect of the invention, there is provided a method of retrofitting an energy management system to a temperature controlled unit for food or beverages. The method comprises locating in the temperature controlled unit a sensor comprising means to measure a temperature and means to transmit wirelessly the measured temperature to a controller, and interposing between the temperature controlled unit and a power supply the controller, the controller being arranged to control electric power to the temperature controlled unit, at least in part, on the basis of the measured temperature.

As an option, the method further comprises locating the sensor such that it measures the temperature in one of a chilled cabinet, product line, python and a cooler bath in the temperature controlled unit.

The method optionally further comprises cutting the electric power to the temperature controlled unit in the event that a measured temperature falls below a first predetermined threshold, and restoring the electric power to the cooler in the event that a measured temperature exceeds a second predetermined threshold. Alternatively, the method comprises cutting the electric power to the temperature controlled unit in the event that a measured temperature rises above a first predetermined threshold, and restoring the electric power to the cooler in the event that a measured temperature falls below a second predetermined threshold.

The method may further comprise storing in a memory at the controller any of historical data and user input data, and controlling electric power to the temperature controlled unit on the basis of any combination of the measured temperature, the historical data and the user input data.

According to a fourth aspect of the invention, there is provided a cooler for cooling food or beverages, the cooler comprising primary cooling means, secondary cooling means, and a controller for controlling a power to at least the secondary cooling means, wherein the controller is arranged during a first time period to provide power to both the primary and secondary cooling means, and during a second time period to provide intermittent power to the secondary cooling means.

In one embodiment, the primary cooling means comprises a refrigeration unit for cooling air, and the secondary cooling means comprises a fan for circulating the cooled air around the food or beverages. In an alternative embodiment, the primary cooling means comprises a cooled bath of fluid, and the secondary cooling means comprises a pump connected to a pipe, the pipe being arranged to draw cooled fluid from the cooled bath of fluid, the pipe being disposed substantially adjacent to the food or beverage such that cooled fluid in the pipe cools the food or beverage. In yet a further embodiment, the primary cooling means comprises an ice making unit, and the secondary cooling means comprises means to more evenly distribute ice made using the ice making unit over a heat exchanger plate.

As an option, the controller comprises a receiver for receiving from a remote sensor a message comprising a measured temperature at the secondary cooling means, wherein the controller is arranged to provide power to the secondary cooling means in the event that the temperature exceeds a first predetermined threshold and to cut power to the secondary cooling means in the event that the temperature falls below a second predetermined threshold.

The cooler optionally further comprises a user input device for allowing a user to input data defining the first time period and the second time period, and a memory for storing the input data.

According to a fifth aspect of the invention, there is provided a controller for use with a cooler as described above in the fourth aspect of the invention.

According to a sixth aspect of the invention, there is provided a controller for a temperature controlled unit for food or beverages, the controller comprising means for determining times at which temperature controlled unit temperature controlling means is in use, a user input device for receiving data input from a user relating to use periods for the temperature controlled unit, a memory for storing the times at which the temperature controlled unit temperature controlling means is in use and the user input data, and a processor for dynamically analysing the information stored in the memory and controlling the operation of the temperature controlled unit temperature controlling means on the basis of a combination of use periods and times at which the temperature controlled unit temperature controlling means is in use.

The processor is optionally arranged to perform the steps of:

a. determining a first predetermined time before a user input use period;
b. turning on the temperature controlled unit temperature controlling means at the predetermined time before the user input use period;
c. determining a time at which the temperature controlled unit temperature controlling means is no longer in use;
d. on the basis of the time at which the temperature controlled unit temperature controlling means is no longer in use, determining a new predetermined time period before a user input use period; and
e. repeating steps b to e.

As an option, the new predetermined time period is determined on the basis of stored historical data in addition to the time at which the temperature controlled unit temperature controlling means is no longer in use.

As a further option, the means for determining times at which temperature controlled unit temperature controlling means is in use are selected from one of means for determining a change in current drawn by the temperature controlled unit and a change in a temperature measured at the temperature controlled unit.

As a further option, the use periods relating to the temperature controlled unit comprise any combination of daily, weekly, monthly and yearly use periods.

According to a seventh aspect of the invention, there is provided a temperature controlled unit for controlling the temperature of food or beverages comprising the controller as described above in the sixth aspect of the invention.

According to an eighth aspect of the invention, there is provided a controller for controlling cooling means for a cooler bath, the cooler bath arranged in use to maintain a mass of solid or semi-solid coolant in addition to liquid coolant, the controller comprising means for determining that the cooling means is not currently active, a receiver for receiving a signal from a temperature sensor located at the cooler bath, the signal including the temperature of the cooler bath, and a processor for determining that the temperature has fallen below a predetermined level and, on the basis of the determination, activating the cooling means such that a mass of solid or semi-solid coolant is maintained at the cooler bath.

The means for determining that the cooling means is not currently active optionally comprises one of determining that the cooling means is not drawing any electrical power and determining that the cooler is not in use during an off-peak time.

According to a ninth aspect of the invention, there is provided a cooler for cooling food or beverages comprising the controller as described above in the eighth aspect of the invention.

According to a tenth aspect of the invention, there is provided a computer program, comprising computer readable code which, when run on a controller for a cooler, causes the controller to behave as a controller as described above.

According to an eleventh aspect of the invention, there is provided a computer program, comprising computer readable code which, when run on a temperature controlled unit for controlling the temperature of food or beverages causes the temperature controlled unit to behave as a temperature controlled unit as described above.

According to a twelfth aspect of the invention, there is provided a computer program, comprising computer readable code which, when run on an energy management system for use in a temperature controlled unit food or beverages causes the energy management system to behave as an energy management system as described above.

According to a thirteenth aspect of the invention, there is provided a computer program product comprising a computer readable medium and a computer program as described above in any of the tenth, eleventh or twelfth aspects of the invention, wherein the computer program is stored on the computer readable medium.

DETAILED DESCRIPTION

Figure 1:
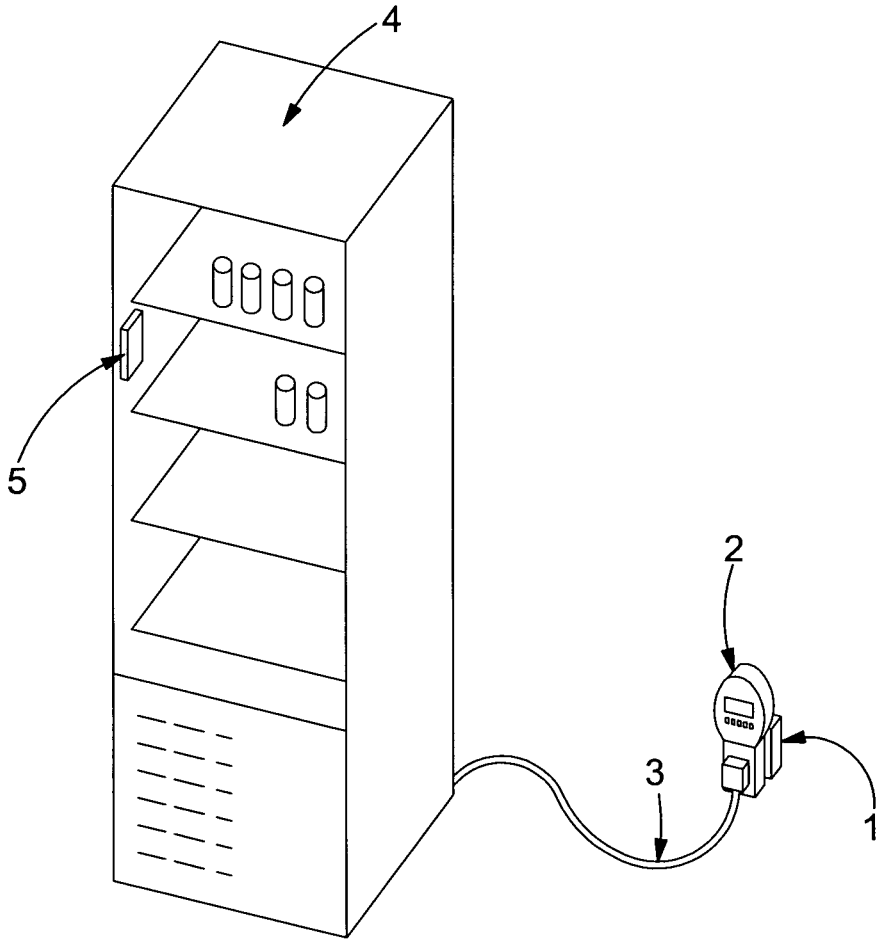
FIG. 1 is a perspective view illustrating a cooler according to a first embodiment of the invention.

Referring to FIG. 1, there is illustrated a power outlet 1 to which a controller 2 is connected. The controller 2 provides power via a power cable 3 to a cooler 4. The cooler in the example of FIG. 1 is of the "glass door", although the invention applies equally to other types of cooler. A sensor 5 is located in a cooled chamber of the cooler 4.

Figure 2:
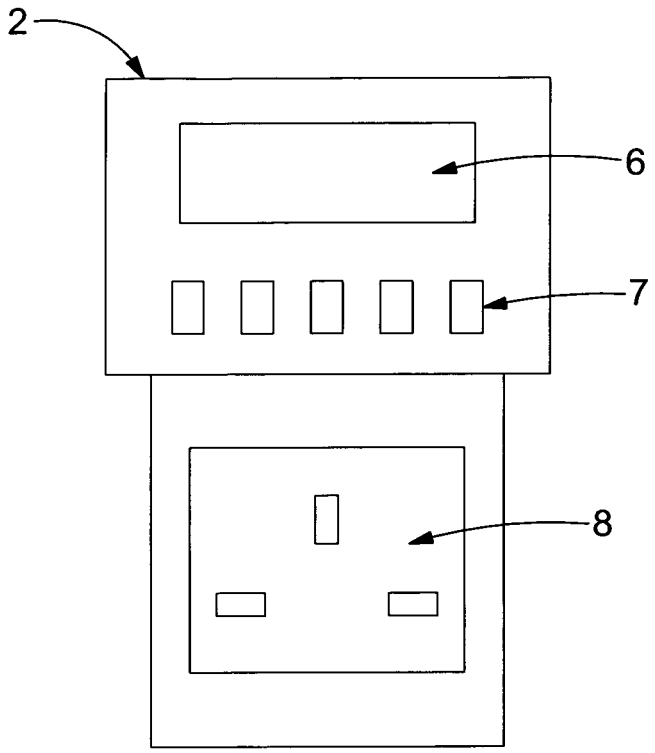
FIG. 2 is a front elevation view of a controller according to the first embodiment of the invention.
Figure 3:
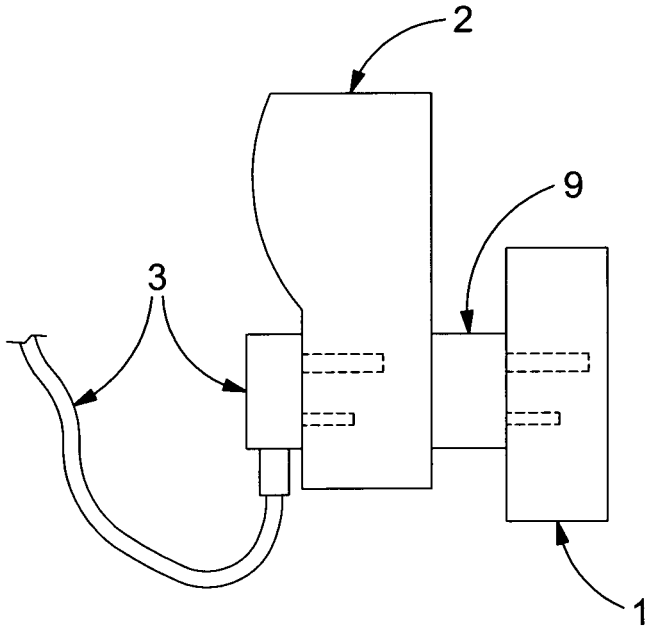
FIG. 3 is a side elevation view of a controller according to the first embodiment of the invention.

Referring now to FIGS. 2 and 3, the controller 2 comprises a display 6, means to allow a user to input data 7, and a power socket 8 for connecting the cooler 4 to the controller. A plug 9 is also provided for connecting the controller 2 to the power outlet 1.

Figure 4:
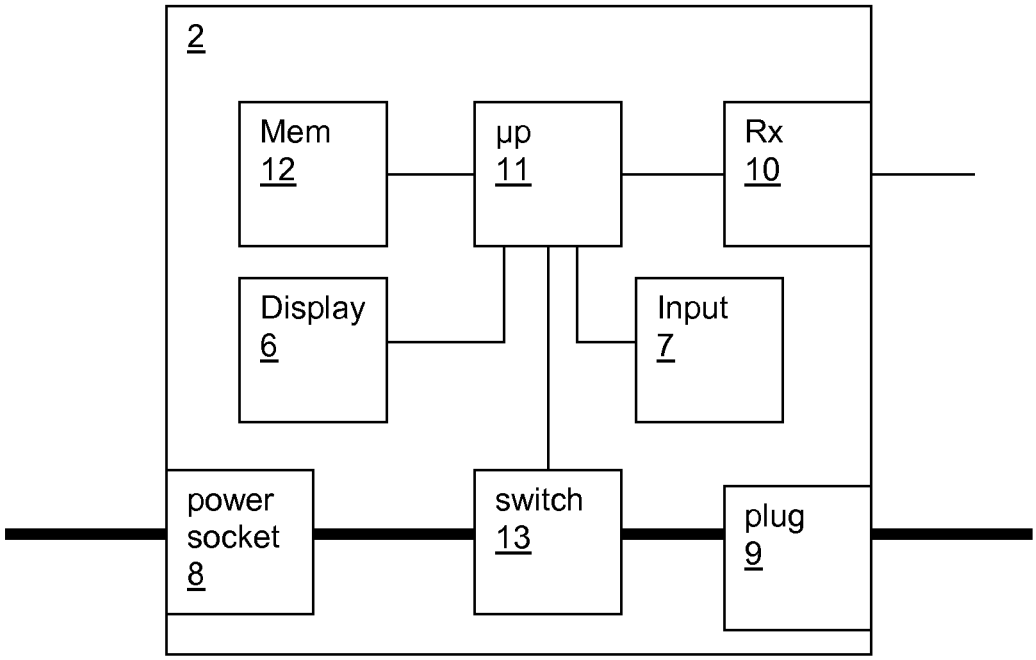
FIG. 4 illustrates schematically in a block diagram a controller according to an embodiment of the invention.

Referring now to FIG. 4, the controller 2 is further provided with a receiver 10, a processor 11 and a memory 12. A switch 13 is located between the socket 8 and the plug 9, the switch 13 being controllable by the processor 11.

Figure 5:
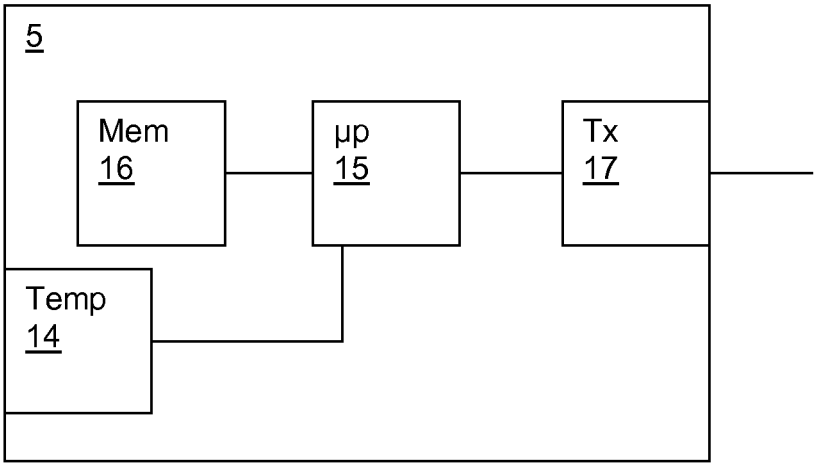
FIG. 5 illustrates schematically in a block diagram a sensor according to an embodiment of the invention.

Referring now to FIG. 5, the sensor 5 comprises means 14 to measure a temperature, a processor 15 and a memory 16 for storing measured temperatures. A transmitter 17 is provided for sending measured temperatures to the controller 2. The transmitted temperature measurement may be an average over time, or may be a single reading (in which case the memory 16 is not required). The processor 15 may transmit temperature measurements periodically or in response to a request from the controller 2. Note that any suitable wireless technology may be used to transmit the temperature measurements from the sensor 5 to the controller 2. The sensor may be powered with a battery (not shown), and have means to send an alarm to the controller or emit an audible or visible alarm such as a flashing light if the battery power is low.

The controller 2 uses the switch 13 to control power to the cooler 4. This is done, at least in part, in response to the received temperature measurements. In a basic embodiment, if the measured temperature rises above a certain value then the processor 11 activates the switch 13 to provide power to the cooler 4, thereby cooling down the goods within the cooler 4. Similarly, if the temperature falls below a predetermined value, then the processor 11 activates the switch 13 to cut power to the cooler 4, thereby allowing the temperature within the cooler 4 to rise.

According to a more sophisticated embodiment, the memory 12 stores historical data relating to time and temperature, and the processor uses this to determine when to activate or deactivate the switch 13.

The controller memory 12 can also be used to store use input data. This may be, for example, opening times of premises in which the cooler 4 is located. The processor 11 can determine that the temperature need not be so cold during closed times as it is during opening times, and can use the measured temperature and/or the historical data to activate or deactivate the switch 13 accordingly. The memory 12 may also be used to store data such as maximum and minimum required temperatures, unit cost of energy used and so on. The display 6 allows the user to see what data has been entered, and view data such as the energy used, the temperature within the cabinet and so on.

As the sensor 5 communicates wirelessly with the controller 2, and the controller 2 is interposed between the power source and the cooler 4, the cooler management system can be easily retrofitted to existing coolers. There is no need to rewire an existing cooler, and the retrofit can take place at the cooler's site, rather than having to recall the cooler to a workshop for a retrofit.

The invention allows the temperature within the cooler 4 to be adjusted depending on the time of day. For example, during trading hours (on-peak), a maximum temperature will be required in order for the food or beverage in the cooler to be maintained at a temperature required by the user. During non-trading hours (off-peak), it may be acceptable to allow the temperature of the food or beverage in the cooler to reach a higher temperature, provided that this is sufficiently low to keep the food or beverage fresh and fit for consumption.

It will be appreciated that whilst the invention is described with reference to a "glass door" cooler, it could be applied to any type of cooler or other apparatus which is used to control temperature.

Considering now a second specific embodiment of the invention, many types of cooler can be thought of as having a "primary" cooling means and a "secondary" cooling means. For example, in the case of a glass door cooler, the primary cooling means is the refrigeration unit for cooling air, and the secondary cooling means is the fan for circulating the cooled air around the product to be cooled. Similarly, a beverage dispenser/cooler described above has a bath of cooled fluid (the "primary" cooling means") and a pump and pipe (the "secondary" cooling means) that draws cooled fluid from the bath to cool down another pipe that dispenses a beverage. In each case, the primary cooling means cools a first stage (the air or the bath of the fluid in the examples above) and the secondary cooling means uses the substance cooled in the first stage to cool a product such as a foodstuff or beverage. The foodstuff or beverage may also be cooled by proximity to the primary cooling means. In a flat plate cooler, an ice bin allows ice to sit on top of the heat exchanger plate. A unit that manufactures the ice can be thought of as the primary cooling means. An ice auger rotates the ice on the plate in order to maintain an even distribution of ice over the plate. This can be thought of as the secondary cooling means. In a known flat plate cooler, the ice auger normally runs continuously.

In the example of a glass door cooler, during off-peak hours it may be unnecessary to keep products within the glass door cooler as cool as they must be during on peak hours. However, some cooling may be required in off-peak hours in order to keep the products fresh. Furthermore, additional cooling will be required towards the end of an off-peak period to reduce the temperature to a desired level before a new on-peak period starts.

Figure 6:
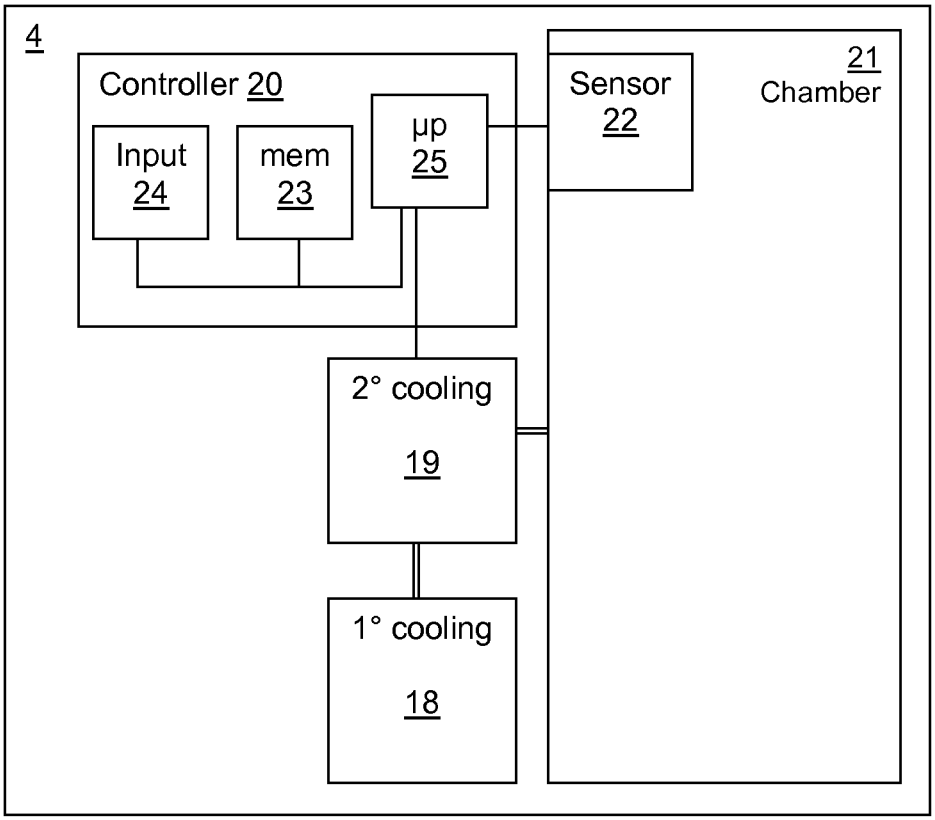
FIG. 6 illustrates schematically in a block diagram a cooler according to an embodiment of the invention.

Referring to FIG. 6, there is illustrated a cooler 4 having primary cooling means 18 and secondary cooling means 19. A controller 20 is provided for controlling operation of the secondary cooling means 19, and the secondary cooling means 19 is operatively connected to a chamber 21 in which food and/or beverages are stored or dispensed. The secondary cooling means 19 cools the chamber 21. A sensor 22 measures the temperature within the chamber 21, and can communicate the measured temperature to the controller 20.

The controller may also be provided with a memory 23, which can be used to store historical data. The memory 23 may also be used to store user input data about off-peak and on-peak hours when the cooler needs to be in use. User input data may be entered using a user data input device 24. Such data is typically entered by service personnel or the other persons maintaining the controller when configuring the device. A processor 25 is also provided for performing operations such as writing data to the memory 23 and controlling the secondary cooler 19.

During off-peak hours, the primary cooler may or may not be in use. However, it is likely to be at a lower temperature than the ambient temperature. The controller 20 receives from the sensor 22 a temperature reading, and if the temperature has risen above a predetermined level, then the controller activates the secondary cooling means 19. In the case of a glass door cooler, this involves activating the fan to blow cool air around the chamber 21, which would otherwise have settled to the bottom of the chamber 21. In the case of a beverage dispenser/cooler, this involves activating a top pump to pump cooled fluid from the cooled fluid bath. In the case of a flat-plate cooler, this involves activating an ice auger to re-distribute ice evenly over the heat exchanger plate.

The user input device 24 allows a user to enter time periods for off-peak and on-peak hours, and the processor 25 uses this data, along with temperature requirements stored in the memory 23, to ascertain the desired temperature for the sensor 22 in the chamber 21. In this way, during off-peak hours, a temperature can be maintained at a low energy cost by simply activating the secondary cooling means 19 and by topping it up by using the primary cooling means 18. Of course, the controller may also be used to control operation of the primary cooler on the basis of a timer, historical data, current data measurements and so on.

The second specific embodiment of the invention can be applied to any type of cooler that has a primary and a secondary cooling means, and the second specific embodiment of the invention is compatible with the first specific embodiment of the invention.

Figure 7:
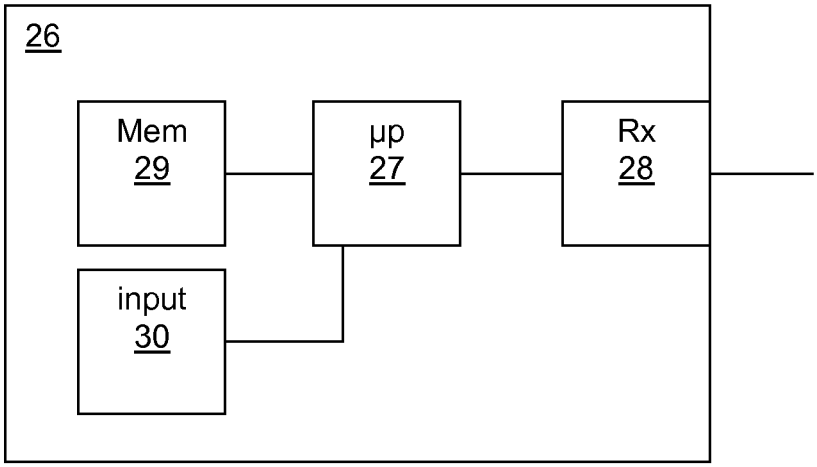
FIG. 7 illustrates schematically in a block diagram a controller according to a further embodiment of the invention.

According to a third specific embodiment of the invention, and with reference to FIG. 7, there is provided a controller 26 for a cooler 4 that is disposed locally at the cooler 4 and dynamically learns (by observing temperature and/or compressor cycling currents) times at which to turn the cooling means for the cooler on or off in order to best maintain the temperature of goods within the cooler chamber 21 most efficiently. This embodiment is compatible with any of the other embodiments described herein.

The controller 26 is provided with a processor 27, a receiver for receiving temperature data from a remote sensor 28, a memory 29 for storing user input data and historical temperature data and a user input device 30 for allowing a user to input data relating to operating times for the cooler 4. The controller has an output to a cooler compressor and controls the power to the compressor.

The processor is arranged to dynamically analyse the use times of the cooler and adjust the times at which the cooling means of the cooler is activated or deactivated in order to most efficiently keep the goods in the cooler cool. Use times are typically determined by analysing the time at which the cooler completes its first pull-down cycle after a non-use (a non-trading) period and the time taken for this first pull-down cycle to complete. During use periods (trading periods), the cooler must ensure that the products contained in the cooler are at a temperature suitable for consumption.

For example, a cooler may be located in a bar and must be ready for use at 11 am. In order to be at the required temperature by 11 am, the cooling means is initially turned on at 9 am. The controller may determine that the cooler was at the required temperature by 10 am. The controller may determine this by way of either the temperature sensor described herein, a change in the current drawn by the cooler (as the compressor stops and hence stops cooling, having reached the required temperature) or any other method. This means that there was an hour between the cooler being at the required temperature and the cooler being required for use, and so is an inefficient use of energy. The processor analyses this time, and the following day turns on the cooling means at 9.45. The cooler is at the required temperature by 10.50. Whilst this is a much more efficient use of energy, the time between the cooler being at the required temperature and the cooler being required is only 10 minutes. This is lower than a predetermined safety margin of 15 minutes, so the following day the processor turns on the cooling means at 9:30.

Figure 8:
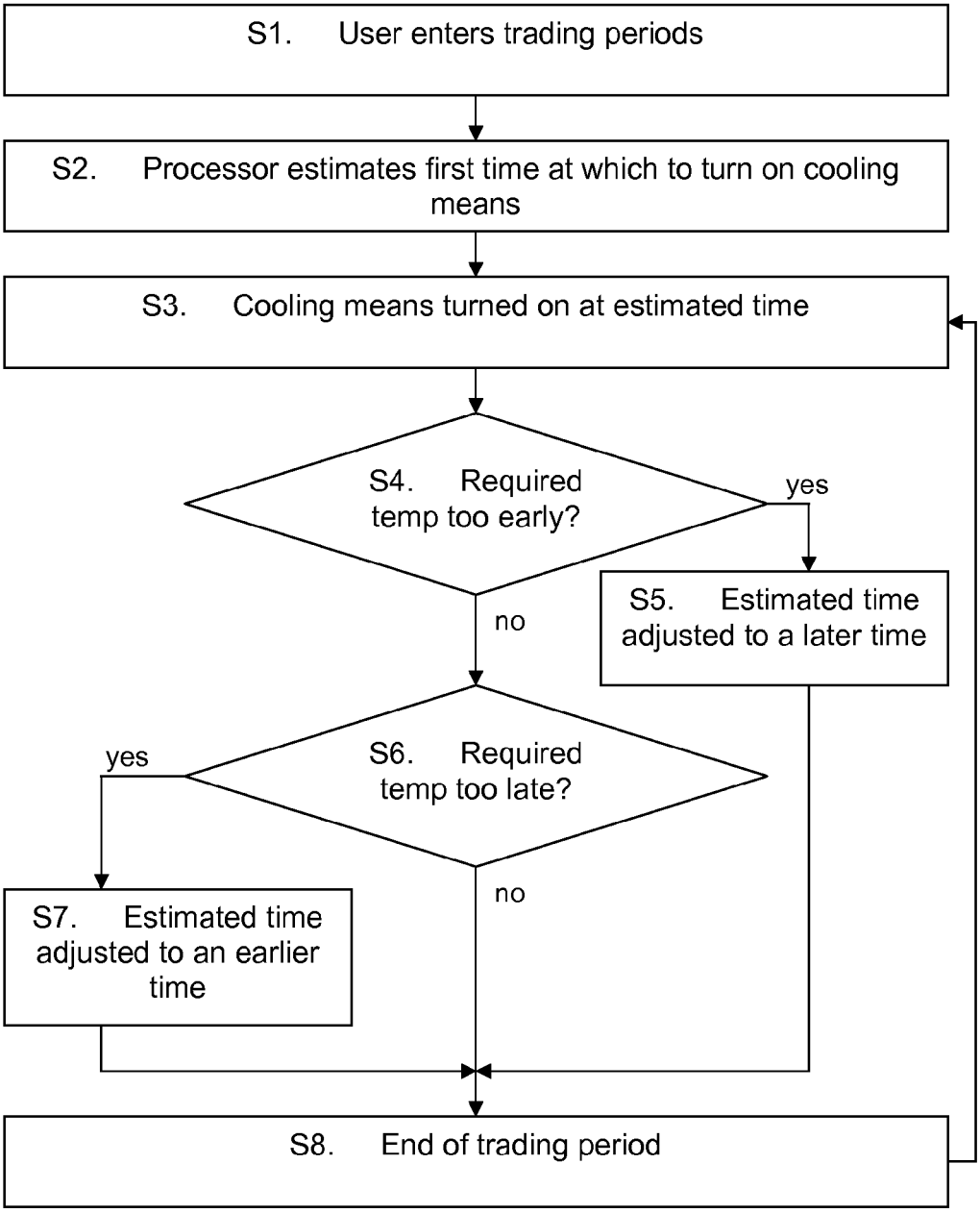
FIG. 8 is a flow diagram illustrating process steps according to an embodiment of the invention.

This iterative process can take into account trading hours (for example, the bar may not open on a Sunday), ambient temperature and so on. The process is summarized in FIG. 8, with the following numbering corresponding to the numbering of FIG. 8:

S1. The user of the cooler enters the trading periods for the cooler. This may include periods at which the cooler is required to be in use, for example daily, weekly, monthly or yearly.

S2. The processor, on the basis of the entered trading periods and other data estimates a first time at which to turn on the cooling means for the cooler.

S3. The processor turns on the cooling means at the estimated time.

S4. A determination is made as to whether the cooler reached the required temperature too early. If not then the process continues at step S6.

S5. The estimated time is adjusted to a later time, taking into account any variations in the trading hours.

S6. A determination is made as to whether the cooler reached the required temperature too late. If not then the process continues at step S8.

S7. The estimated time is adjusted to an earlier time, taking into account any variations in the trading hours.

S8. The trading period ends and the cooling means is turned off. The process then reverts to step S3.

Data relating to the estimates made by the controller and/or any data relating to the performance of the cooler as a result of these estimates being implemented may be stored by the controller and may be utilised in any further calculations and/or decisions made by the controller at a future time. For example, an estimate made for the start of trading on a Monday may be stored and used the following Monday in conjunction with the "on-going" estimate.

The third specific embodiment can be applied to any type of food or beverage cooler, and is compatible with either or both of the first and second specific embodiments.

A fourth specific embodiment of the invention applies to coolers that use a bath to maintain a low temperature. When the cooler is in use, a mass of solid or semi-solid coolant builds up in the ice bath which serves to cool a liquid associated with the solid or semi-solid coolant that is used for cooling. An example of a solid coolant is ice in an ice bank. An example of a semi-solid coolant is a "soft" ice bank formed by a mixture of glycol and water.

When the cooler is turned off, the solid or semi-solid coolant begins to melt. At some point the solid or semi-solid coolant reaches a critical size, below which melting of the solid or semi-solid coolant and warming of the liquid in the bath occurs very rapidly. When the cooler is subsequently turned on again, it takes a considerable amount of time and energy to replenish the solid or semi-solid coolant and to cool the liquid to the required temperature.

Figure 9:
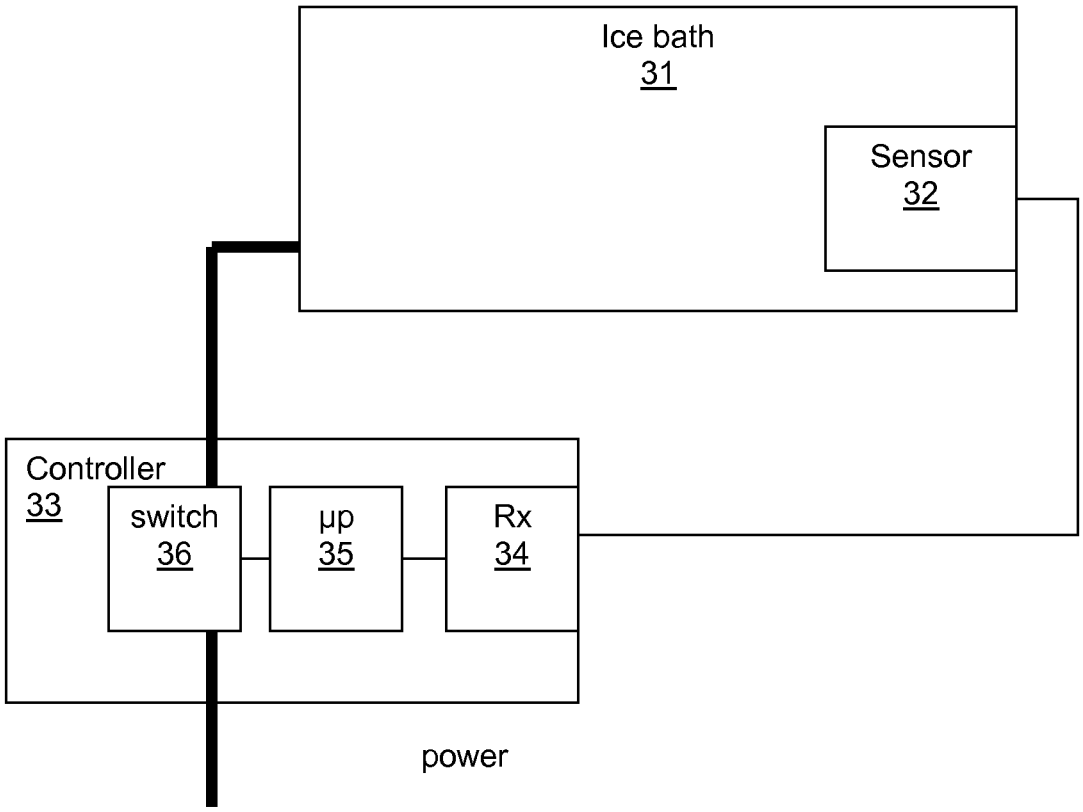
FIG. 9 illustrates schematically in a block diagram an ice bath and a controller according to a further embodiment of the invention.

Referring to FIG. 9 herein, there is illustrated an ice bath 31. A temperature sensor 32 is located in the ice bath. The temperature sensor communicates with a controller 33 via a receiver 34 at the controller 33. The controller is further provided with a processor 35, which is used to control a switch 36 for connecting or disconnecting power to the ice bath 31. The controller 33 may also be provided with a memory (not shown) to store data.

When the power to the ice bath 31 is not on, the solid or semi-solid coolant will start to melt and the temperature of the liquid in the ice bath 31 increases. The sensor 32 sends periodic temperature readings to the controller 33. When the processor 35 determines that the temperature has reached a critically high level, it activates the switch to allow power to the ice bath, thereby cooling the ice bath and rebuilding the amount of solid or semi-solid coolant. Once the temperature in the ice bath 31 has dropped below a predetermined level, or after a predetermined amount of time, the power to the ice bath 31 is cut off.

By intermittently allowing power to the ice bath 31 during off-peak times when the ice bath 31 is not normally in use, the amount of solid or semi-solid coolant is maintained, albeit in a reduced size. This is a much more energy efficient way of operating the ice bath 31 than allowing the solid or semi-solid coolant to melt completely and then rebuilding the solid or semi-solid coolant prior to the next trading period.

The fourth specific embodiment of the invention is compatible with any combination of the first, second and third embodiments of the invention.

All of the above-described embodiments improve the efficiency of coolers. Any of the embodiments may be partly embodied in hardware or in software equivalents that perform the same functions. It will be appreciated by the person of skill in the art that various modifications may be made to the above-described embodiments without departing from the scope of the invention according to the appended claims. For example, whilst the above description refers to cooling of food and beverages, it will be appreciated that it can be simply adapted to heaters for food and beverages, for example water boilers, or adapted for use with heating, ventilating and air conditioning systems.

The invention claimed is:

1. A controller for a temperature controlled unit for food or beverages, the controller comprising:

a device configured to determine times at which temperature controlled unit temperature controller is in use;

a user input device configured to receive data input from a user relating to use periods for the temperature controlled unit, wherein the use periods relating to the temperature controlled unit comprise any combination of minutes, hours, daily, weekly, monthly and yearly use periods;

a memory configured to store the times at which the temperature controlled unit temperature controller is in use and the user input data;

a processor configured to dynamically analyze the information stored in the memory and control the operation of the temperature controlled unit temperature controller on the basis of a combination of use periods and times at which the temperature controlled unit temperature controller is in use.

2. The controller according to claim 1, wherein the processor is arranged to perform the steps of:

a. determining a first predetermined time before a user input use period;

b. turning on the temperature controlled unit temperature controller at the predetermined time before the user input use period;

c. determining a time at which the temperature controlled unit temperature controller is no longer in use;

d. on the basis of the time at which the temperature controlled unit temperature controller is no longer in use, determining a new predetermined time period before a user input use period; and e. repeating steps b to e.

3. The controller according to claim 2, wherein the new predetermined time period is determined on the basis of stored historical data in addition to the time at which the temperature controlled unit temperature controller is no longer in use.

4. The controller according to claim 1, wherein the device configured to determine times at which temperature controlled unit temperature controller is in use is selected from one of a device configured to determine a change in current drawn by the temperature controlled unit and a device configured to determine a change in a temperature measured at the temperature controlled unit.

5. The temperature controlled unit for food or beverages comprising the controller as claimed in claim 1.

6. A method of controlling the temperature of a temperature controlled unit for food or beverages, the method comprising:

determining times at which a temperature controlled unit temperature controller is in use;

receiving, from a user input device, data input from a user relating to use periods for the temperature controlled unit, wherein the use periods relating to the temperature controlled unit comprise any combination of minutes, hours, daily, weekly, monthly and yearly use periods;

storing in a computer readable memory the times at which the temperature controlled unit temperature controller is in use and the user input data;

dynamically analysing the information stored in the computer readable memory and controlling the operation of the temperature controlled unit temperature controller on the basis of a combination of use periods and times at which the temperature controlled unit temperature controller is in use.

7. The method according to claim 6, further comprising, at the processor, performing the steps of:

a. determining a first predetermined time before a user input use period;

b. turning on the temperature controlled unit temperature controller at the predetermined time before the user input use period;

c. determining a time at which the temperature controlled unit temperature controller is no longer in use;

d. on the basis of the time at which the temperature controlled unit temperature controller is no longer in use, determining a new predetermined time period before a user input use period; and e. repeating steps b to e.

8. The method according to claim 7, further comprising determining the new predetermined time period on the basis of stored historical data in addition to the time at which the temperature controlled unit temperature controller is no longer in use.

9. The method according to claim 6, wherein the times at which the temperature controlled unit temperature controller is in use is determined by any of determining a change in current drawn by the temperature controlled unit and determining a change in a temperature measured at the temperature controlled unit.

10. A computer program, comprising computer readable code which, when run on a controller for a temperature controlled unit for food or beverages, causes the controller to perform the method as claimed in claim 6.

11. A controller configured to control a cooler for a cooler bath, the cooler bath arranged in use to maintain an amount of solid or semi-solid coolant in addition to liquid coolant, the controller comprising:

a device configured to determine that the cooler is not currently active;

a receiver configured to receive a signal from a temperature sensor located at the cooler bath, the signal including the temperature of the cooler bath; and a processor configured to determine that the temperature has risen above a predetermined level and, on the basis of the determination, activating the cooler such that an amount of solid or semi-solid coolant is maintained at the cooler bath.

12. The controller according to claim 11, wherein the device configured to determine that the cooler is not currently active comprises one of a device configured to determine that the cooler is not drawing any electrical power and a device configured to determine that the cooler is not in use during an off-peak time.

13. A cooler configured to cool food or beverages comprising the controller as claimed in claim 11.

14. A method of controlling a cooler for a cooler bath, the cooler bath arranged in use to maintain an amount of solid or semi-solid coolant in addition to liquid coolant, the method comprising:

determining that the cooler is not currently active;

using a receiver, receiving a signal from a temperature sensor located at the cooler bath, the signal including the temperature of the cooler bath; and using a processor, determining that the temperature has risen above a predetermined level and, on the basis of the determination, activating the cooler such that an amount of solid or semi-solid coolant is maintained at the cooler bath.

15. A computer program product comprising a non-transitory computer readable medium and a computer program according to claim 14, wherein the computer program is stored on the non-transitory computer readable medium.

16. A computer program, comprising computer readable code which, when run on a controller configured to control the cooler for the cooler bath, causes the controller configured to control the cooler for the cooler bath to perform the method as claimed in claim 14.

17. A computer program product comprising a non-transitory computer readable medium and a computer program according to claim 16, wherein the computer program is stored on the non-transitory computer readable medium.

* * * * *